US006773295B2

(12) United States Patent
Lindemann et al.

(10) Patent No.: US 6,773,295 B2
(45) Date of Patent: Aug. 10, 2004

(54) CLAMPING DEVICE WITH A CONNECTION FOR CABLE STRANDS

(75) Inventors: Kai-Uwe Lindemann, Preussisch Oldendorf (DE); Georg Staperfeld, Osnabrück (DE)

(73) Assignee: Harting Electric GmbH & Co. KG (DE)

( * ) Notice: Subject to any disclaimer, the term of this patent is extended or adjusted under 35 U.S.C. 154(b) by 0 days.

(21) Appl. No.: 10/426,394

(22) Filed: Apr. 30, 2003

(65) Prior Publication Data

US 2003/0207610 A1 Nov. 6, 2003

(30) Foreign Application Priority Data

May 4, 2002 (DE) ..... 102 20 108

(51) Int. Cl.[7] ..... H01R 11/20
(52) U.S. Cl. ..... 439/428; 439/805
(58) Field of Search ..... 439/427, 428, 439/784, 805, 807, 863; 24/136 B, 136 R, 136 L, 122.6; 174/84 R, 85

(56) References Cited

U.S. PATENT DOCUMENTS 1,699,825 A 1/1929 Waltz
3,560,909 A * 2/1971 Wyatt et al. ..... 439/428
5,487,679 A 1/1996 Quaintance ..... 439/428

FOREIGN PATENT DOCUMENTS

| | | | |
|---|---|---|---|
| DE | 8914460 | 12/1989 | ..... H01R/11/20 |
| DE | 19718004 | 4/1997 | ..... H01R/15/00 |
| FR | 618171 | 6/1926 | |
| FR | 2810457 | 11/2001 | ..... H01R/4/22 |

* cited by examiner

*Primary Examiner*—Tho D. Ta
*Assistant Examiner*—James R. Harvey
(74) *Attorney, Agent, or Firm*—Hayes Soloway P.C.

(57) ABSTRACT

For a detachable electrical onnection of high-current contacts with cable strands, a clamping device is formed from a clamping tube and a contact part. The clamping tube is provided with a funnel-shaped connection opening and a connection chamber, into which the cable strands are insertable, wherein a clamping shoulder with a conical surface provided in the connection chamber adjoins the connection opening. The contact part, which can be screwed in the centre of the clamping tube and is thus displaceable axially, likewise has a conical surface, which penetrates the centre etween the bared strands on assembly and presses these against the conical surfaces and the clamping shoulder. The angles of the conical surfaces in the connection chamber and the contact part are executed differently in this case.

2 Claims, 3 Drawing Sheets

CLAMPING DEVICE WITH A CONNECTION FOR CABLE STRANDS

FIELD OF THE INVENTION

The invention relates to a clamping device with a connection for cable strands, the clamping device being formed from a clamping tube and a mandrel-like contact part that can be held in the clamping tube by screwing, a funnel-shaped opening being provided on the clamping tube, into which opening the bared cable strands can be inserted as far as an inner connection chamber, and the contact part being able to be screwed with its tip and its conical surface into the cable strands and the strands being pressed against a clamping shoulder in the end of the connection.

A clamping device of this kind is provided to connect high-current connections with cable strands mechanically fixedly to the contact element, wherein even high tensile forces and vibrations cannot cause any undesirable separation of the connection.

DESCRIPTION OF RELATED ART

It is known to connect the connection end of cable strands with crimp connections to a contact element, or to connect cable strands to contact elements in which a cone-shaped contact part in a contact element presses the stranded conductors by means of axial or radial forces onto a correspondingly formed opposing surface, the angles of the conical surfaces being the same, however.

A clamping device of this kind for connecting cable strands is described in DE 89 14 460 U1.

It is disadvantageous in this case that such clamping devices have a relatively large structural volume or do not possess sufficiently great long-term stability with regard to security against pulling out or vibration. The object of the invention is therefore to create a detachable connection between a contact element of the type named at the beginning and a cable strand to the effect that, in addition to optimal electrical contact properties, the cable strand is held in the contact element with a high degree of security against pulling out, especially in the event of vibration influences.

BRIEF SUMMARY OF THE INVENTION

This object is achieved in that the contact part has a cone-shaped tip, the conical surface of which is at an angle $\alpha$ to the vertical, that on its side facing the conical surface of the contact part the clamping shoulder has a conical surface at an angle $\beta$ to the vertical, and that the angle $\alpha$ of the conical surface of the tip of the contact part is smaller than the angle $\beta$ of the conical surface of the clamping shoulder, and that the contact part can only be screwed so far into the connection chamber, and into the cable strand inserted therein, that a minimum overlap remains between the conical surface of the contact part and the conical surface of the shoulder.

In a nreferred embodiment of the invention the angle ($\alpha$) of the conical surface of the contact part and the angle ($\beta$) of the conical surface on the clamping shoulder is at least 2.5°.

The advantages achieved with the invention consist in particular in the fact that, in the case of a high-current contact that is developed as a terminal connection with a clamping device for connection for cable strands with a clamping tube and a centrally guided contact part, which is pressed axially into the centre of the cable strands inserted into a connection chamber, and due to different angles of a conical surface of a clamping shoulder and the conically shaped tip of the contact part, a substantially greater squeezing is achieved in the conical zone than is possible with conventional designs in which the angles of the conical surfaces are executed parallel.

This results in turn in greater long-term stability with reference to the electrical contacting, improved resistance to loosening of the clamping in the event of vibrations and finally, due to the gas-tight squeezing achieved hereby, also to optimal electrical contact resistances.

Furthermore, the security of the cable strands against being pulled out of the contact element is far higher compared with contact elements of this kind that are already known.

A further advantage of this embodiment is that the cable strands no longer "roll" too when being screwed tight and thus no longer cause any grating noises.

A practical example of the invention is shown in the drawing and is explained in greater detail below.

DETAILED DESCRIPTION OF THE INVENTION

Figure 1:
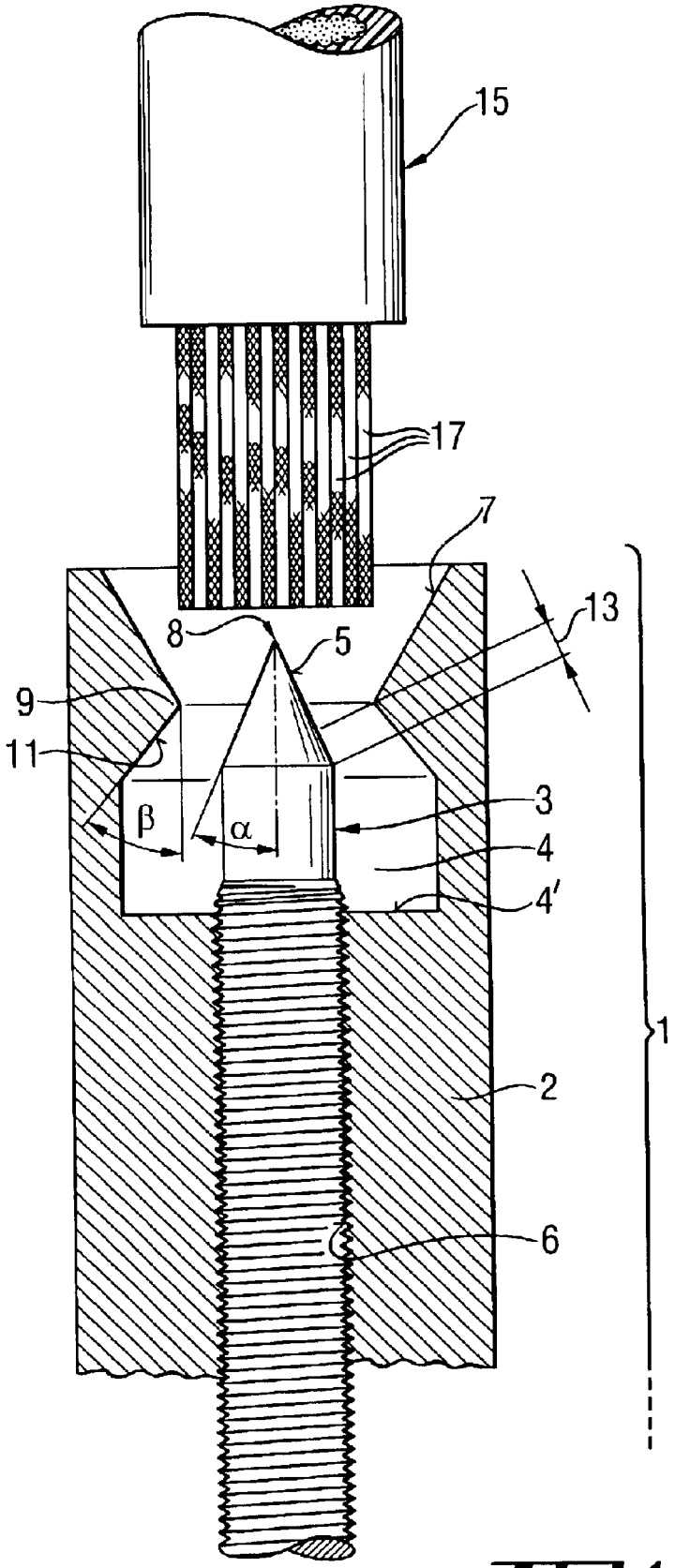
FIG. 1 shows a sectional representation of the connection area of a clamping device with a clamping tube and a contact part guided therein.

In FIG. 1, a clamping device 1 rated for high current transmissions is shown in a sectional view and is formed from a clamping tube 2 with a contact part 3 that can be screwed therein.

The clamping tube is formed as a solid turned part with a continuous threaded hole 6 for the contact part and provided with a connection end that has a funnel-shaped connection opening 7 with a clamping shoulder 9 and a connection chamber 4.

Viewed in the direction of insertion of the stranded conductor, the funnel-shaped connection opening passes into a clamping shoulder 9, which narrows the cross-section and which is adjoined by the connection chamber 4 that in turn widens the cross-section.

Inside the connection chamber and adjoining the clamping shoulder 9 is a conical surface 11.

Opposing this conical surface 11 is a conical surface 5 of the contact part 3, with the difference in relation to conventional designs of this type that the angles of the respective conical surfaces do not run parallel, but that the angle $\alpha$ of conical surface 5 at 27.5° is executed smaller than the angle $\beta$ of the conical surface 11 at 30° (relative to the axis in each case) below the clamping shoulder 9.

Figure 2:
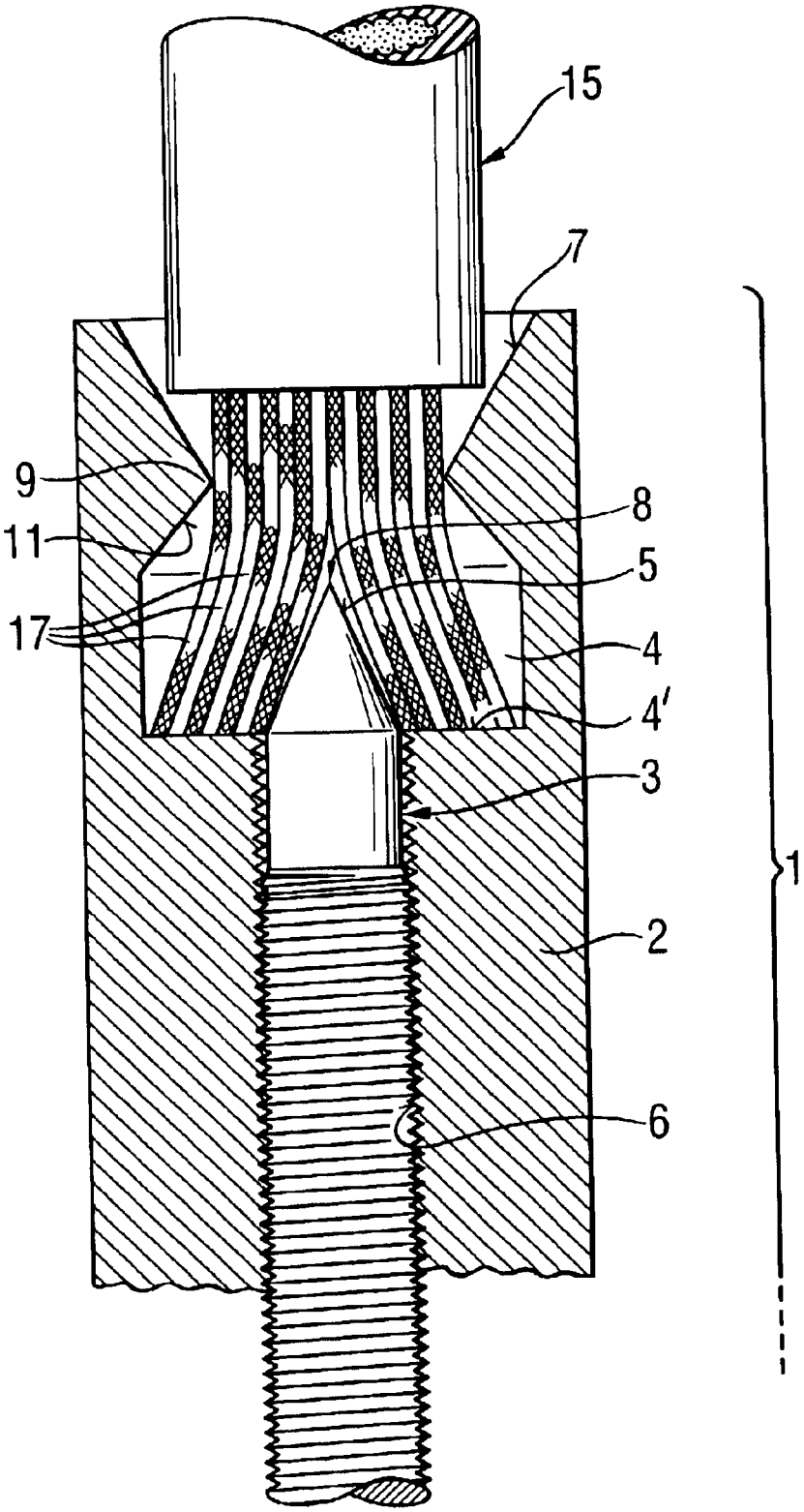
FIG. 2 shows a sectional representation of the connection area of the clamping tube with a cable strands inserted therein.

The axial displacement of the contact part 3 shown in FIG. 2 due to a screw movement is effected by means of a hexagon socket tool, which is inserted into a recess provided for this on the side of the contact part 3 opposing the cone tip 8.

On assembly, the stranded conductor 15 with its suitably cable strands 17 is inserted into the connection chamber 4 as far as the stop on the bottom surface 4', the contact part 3 being screwed back inside the threaded hole 6 so far that only the conical surface 5 protrudes from the bottom area 4'.

Figure 3:
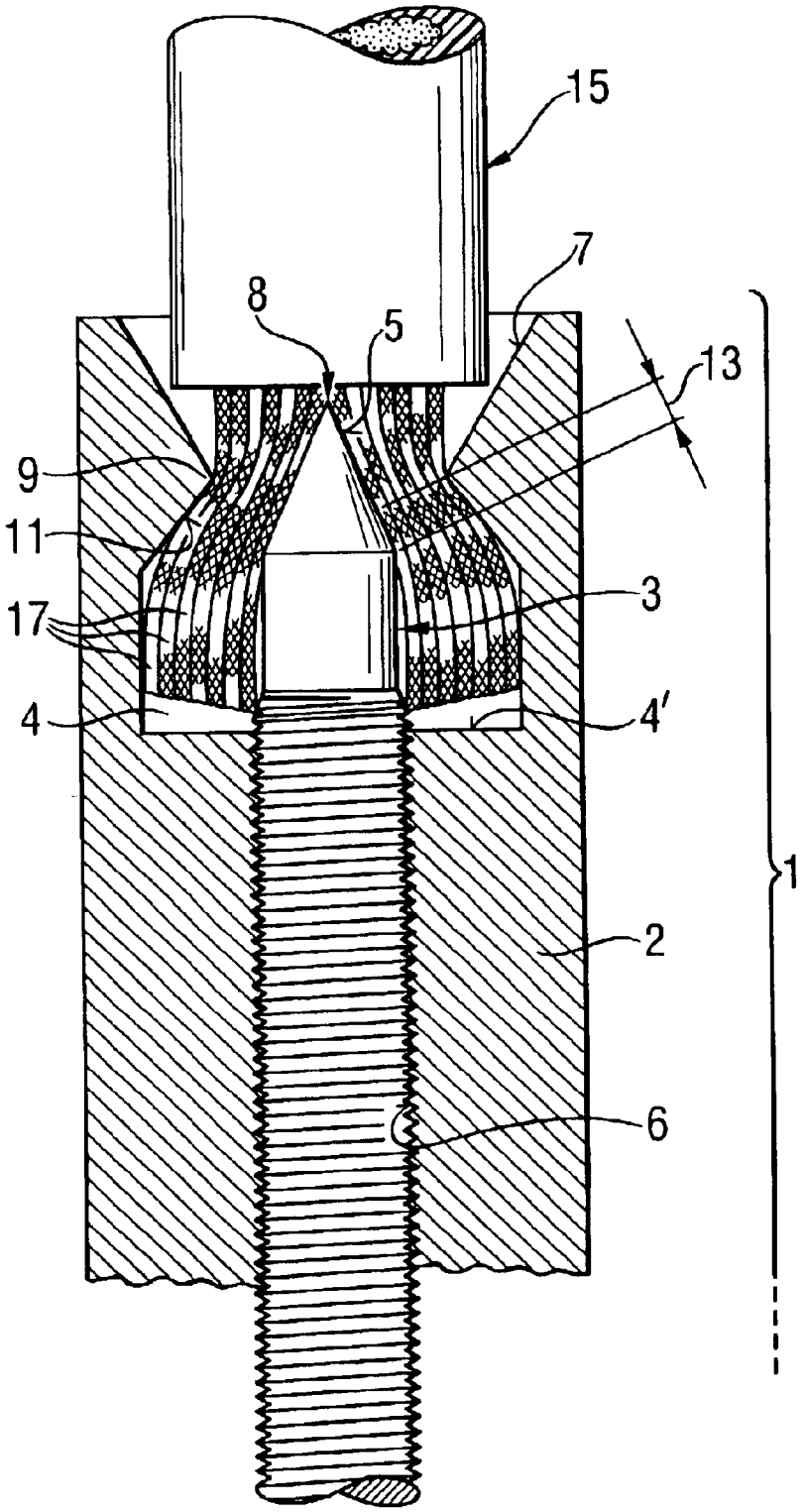
FIG. 3 shows an assembled, gas-tight terminal connection between the contact element and the cable strands.

After the cable strands has been inserted, the contact part 3 is screwed in in the direction of the stranded conductor 15, the cable strands 17 being pressed below the clamping shoulder 9 against and between the two conical surfaces 5 and 11, so that in this area, as indicated in FIG. 3, a gas-tight connection is produced between the conical surfaces and the cable strands 17.

The size ratio of a contact element 1 in relation to the cable strands 15 should be selected here such that a minimum overlap 13 with a length of approximately 3–5 mm is ensured between the two conical surfaces 5, 11. Only thus can a secure terminal connection of the strands between the conical surfaces provided with different angles be achieved that is effective with very high pull-out forces, is gas-tight and non-positively and positively locking.

What is claimed is:

1. A clamping device with a connection for cable strands, the clamping device being formed from a clamping tube having a mandrel-like contact part held in the clamping tub by screwing, a funnel-shaped connection opening provided on the clamping tube, into which opening bared cable strands are inserted as far as an inner connection chamber, the a conically shaped contact part having a tip end and a conical surface being screwe into the cable strands with its tip, its conical surface and the strands being pressed against a conically shaped surface of a clamping shoulder in the connection opening, wherein the conical surface of the contact part has an angle ($\alpha$) to a vechical line drawn through the conically shaped contact part, the clamping shoulder has a conical surface with an angle ($\beta$) to a line narallel to said vertical line on a side facing the nical surface of the contact part, and the angle ($\alpha$) of the conical surface of the contact part is smaller than the angle ($\beta$) of the conical surface of the clamping shoulder, the contact part being screwed into the connection chamber and into the cable strand inserted the in so far that a minimum overlap remains between the conical surface of the contact part a the conical surface of the shoulder.

2. The clamping device as claimed in claim 1, wherein the difference between the angle ($\alpha$) of the conical surface of the contact part and the angle ($\beta$) of the conical surface on the ciam shoulder is at least 2.5°.

* * * * *

UNITED STATES PATENT AND TRADEMARK OFFICE

CERTIFICATE OF CORRECTION

PATENT NO. : 6,773,295 B2
DATED : August 10, 2004
INVENTOR(S) : Lindemann et al.

It is certified that error appears in the above-identified patent and that said Letters Patent is hereby corrected as shown below:

Title page,
Item [57], ABSTRACT,
Line 1, “onnection” should be -- connection --.
Line 11, “etween” should be -- between --.

Column 3,
Line 21, “tub” should be -- tube --.

Column 4,
Line 2, delete the word “the”.
Line 3, “screwe” should be -- screwed --.
Line 10, “narallel” should be -- parallel --.
Line 10, “nical” should be -- conical --.
Line 15, “the in” should be -- therein --.
Line 16, “part a the conical” should be -- part and the conical --.
Line 21, “ciam” should be -- clamping --.

Signed and Sealed this

Thirtieth Day of November, 2004

JON W. DUDAS
*Director of the United States Patent and Trademark Office*